US009931012B2

(12) United States Patent
Ichikawa et al.

(10) Patent No.: US 9,931,012 B2
(45) Date of Patent: Apr. 3, 2018

(54) VACUUM CLEANER

(71) Applicant: TOSHIBA LIFESTYLE PRODUCTS & SERVICES CORPORATION, Kawasaki-shi (JP)

(72) Inventors: Hiromitsu Ichikawa, Owariasahi (JP); Masatoshi Tanaka, Seto (JP); Atsushi Morishita, Hadano (JP); Yukio Machida, Owariasahi (JP); Hiromitsu Murata, Kasugai (JP)

(73) Assignee: TOSHIBA LIFESTYLE PRODUCTS & SERVICES CORPORATION, Kawasaki-shi (JP)

( * ) Notice: Subject to any disclaimer, the term of this patent is extended or adjusted under 35 U.S.C. 154(b) by 0 days.

(21) Appl. No.: 15/304,806

(22) PCT Filed: Apr. 22, 2015

(86) PCT No.: PCT/JP2015/062264
§ 371 (c)(1),
(2) Date: Oct. 17, 2016

(87) PCT Pub. No.: WO2015/163373
PCT Pub. Date: Oct. 29, 2015

(65) Prior Publication Data

US 2017/0049289 A1 Feb. 23, 2017

(30) Foreign Application Priority Data

Apr. 22, 2014 (JP) ..... 2014-088361

(51) Int. Cl.

| | |
|---|---|
| ***A47L 9/28*** | (2006.01) |
| ***A47L 11/40*** | (2006.01) |
| ***A47L 9/04*** | (2006.01) |

(52) U.S. Cl.
CPC ..... *A47L 11/4052* (2013.01); *A47L 9/04* (2013.01); *A47L 9/28* (2013.01); *A47L 11/4038* (2013.01);
(Continued)

(58) Field of Classification Search
CPC ..... A47L 11/4052; A47L 11/4069; A47L 11/4038; A47L 9/04; A47L 2201/00; A47L 2201/04; A47L 9/28
See application file for complete search history.

(56) References Cited

U.S. PATENT DOCUMENTS

2013/0291331 A1 11/2013 Yang et al.
2015/0265122 A1* 9/2015 Han ..... A47L 9/00 15/49.1
2016/0157691 A1* 6/2016 Maoro ..... A47L 9/0472 15/383

FOREIGN PATENT DOCUMENTS

EP 2 578 127 A1 4/2013
EP 2 604 163 A2 6/2013
(Continued)

OTHER PUBLICATIONS

International Search Report dated Jul. 21, 2015 in PCT/JP15/062264 Filed Apr. 22, 2015.

*Primary Examiner* — David Redding
(74) *Attorney, Agent, or Firm* — Oblon, McClelland, Maier & Neustadt, L.L.P.

(57) ABSTRACT

A vacuum cleaner includes: a body case having an outer circumferential surface formed along either a circular arc or a polygon; a drive wheel allowing travel of the body case on a cleaning target surface; a side brush provided to the body case to be movable in a certain direction. The side brush: projects from the outer circumferential surface of the body case by an amount that changes in response to movement; includes a brush body movable to retreat toward the outer
(Continued)

circumferential surface of the body case in response to external force acting in a direction crossing the certain direction; and includes a cleaning unit rotatably provided to the brush body. The cleaning unit rotates to clean the cleaning target surface. The side brush projecting from an outer circumferential surface of a body case can retreat readily and reliably when the side brush contacts an obstacle.

4 Claims, 5 Drawing Sheets

(52) U.S. Cl.
CPC ..... *A47L 11/4041* (2013.01); *A47L 11/4061* (2013.01); *A47L 11/4066* (2013.01); *A47L 11/4069* (2013.01); *A47L 2201/04* (2013.01)

(56) References Cited

FOREIGN PATENT DOCUMENTS

| | | | |
|---|---|---|---|
| JP | 62-292124 | A | 12/1987 |
| JP | 2013-81775 | A | 5/2013 |
| JP | 2013-89256 | A | 5/2013 |
| KR | 10-2013-0037448 | A | 4/2013 |
| WO | 2013/051843 | A1 | 4/2013 |

* cited by examiner

VACUUM CLEANER

CROSS REFERENCE TO RELATED APPLICATIONS

The present application is a National Stage Application of PCT/JP2015/062264 filed on Apr. 22, 2015. The PCT application claims priority to Japanese Patent Application No. 2014-088361 filed on Apr. 22, 2014. All of the above applications are herein incorporated by reference in their entirety.

FIELD

Embodiments described herein relate generally to a vacuum cleaner including a cleaning part movably provided to a body case.

BACKGROUND

A conventionally-known so-called autonomous traveling type vacuum cleaner (cleaning robot), for example, cleans a cleaning target surface while traveling autonomously on the cleaning target surface and detecting an obstacle or the like by using a sensor and the like. Such a vacuum cleaner includes a body case with a dust collecting part, and the like. A dust collecting port communicating with the dust collecting part is formed in a lower part of the body case. A pair of drive wheels to make the body case travel autonomously is attached to the lower part of the body case. The body case is provided with the dust collecting part. For cleaning, dust and dirt is fed to the dust collecting part through the dust collecting port with an electric blower housed in the body case or a rotary brush arranged at the dust collecting port.

In this vacuum cleaner, the positioning of the drive wheels on both sides of the dust collecting port make it impossible to broaden the dust collecting port in a direction toward both sides. Thus, for cleaning of a place beyond the reach of the dust collecting port such as one near a wall, for example, side brushes with which dust and dirt is to be swept up and collected into the dust collecting port are provided on both sides of the lower part of the body case and ahead of the drive wheels. In this structure, making the side brushes project as much as possible from the body case expands a cleanable area. However, if the side brushes project excessively from the body case, the side brushes may get snagged on an obstacle and the like while the body case is traveling and cause a risk of interfering with the travel. Thus, it is preferable that the side brushes project from the body case but retreat immediately when the side brushes contact an obstacle.

CITATION LIST

Patent Literature

PTL 1: Japanese Laid-open Patent Publication No. 2013-89256

SUMMARY OF INVENTION

A problem to be solved by this invention is to provide a vacuum cleaner capable of making a cleaning part projecting from an outer side surface of a body case retreat readily and reliably when the cleaning part contacts an obstacle.

Solution to Problem

A vacuum cleaner of this embodiment includes a body case having an outer side surface formed along either a circular arc or a polygon. The vacuum cleaner includes a drive wheel to allow travel of the body case on a cleaning target surface. The vacuum cleaner also includes a cleaning part provided to the body case so as to be movable in a certain direction. The cleaning part is to project from the outer side surface of the body case by an amount that changes in response to movement. The cleaning part includes a cleaning part body that is movable so as to retreat toward the outer side surface of the body case in response to external force acting in a direction crossing the certain direction. The cleaning part includes a cleaning unit rotatably provided to the cleaning part body. The cleaning unit is to rotate to clean the cleaning target surface.

DETAILED DESCRIPTION

Figure 1A:
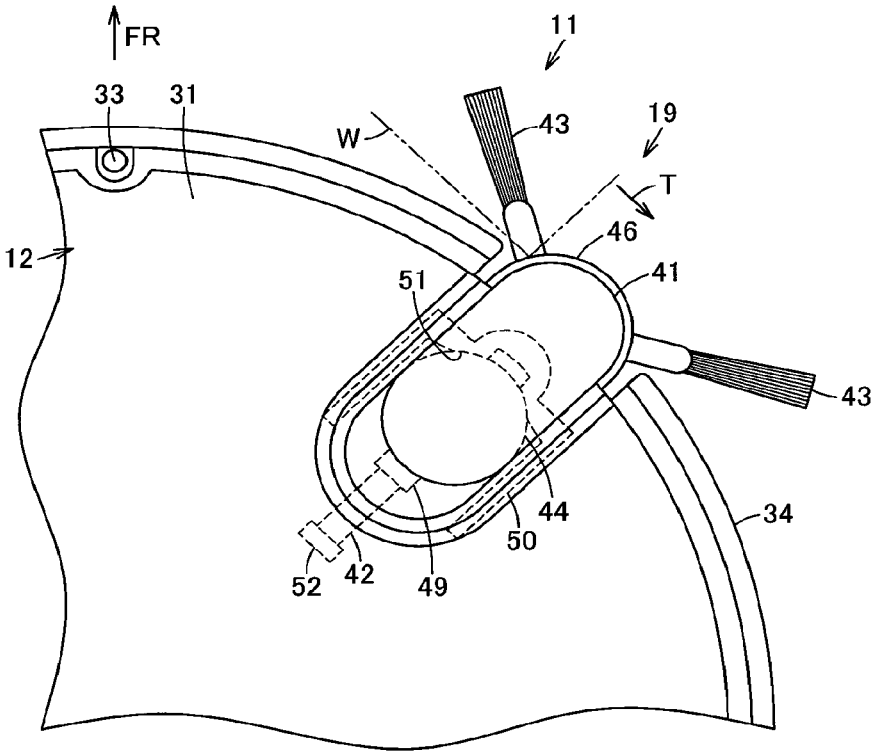
FIG. 1A is a plan view schematically showing a state where a cleaning part of a vacuum cleaner according to a first embodiment advances relative to a body case.
Figure 1B:
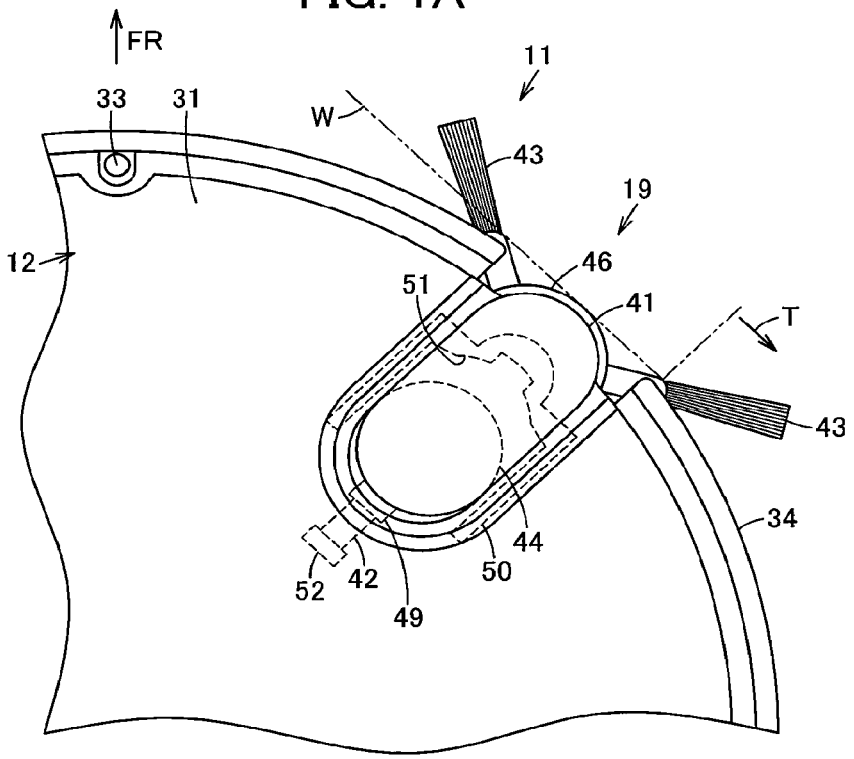
FIG. 1B is a plan view schematically showing a state where the cleaning part retreats relative to the body case.
Figure 2:
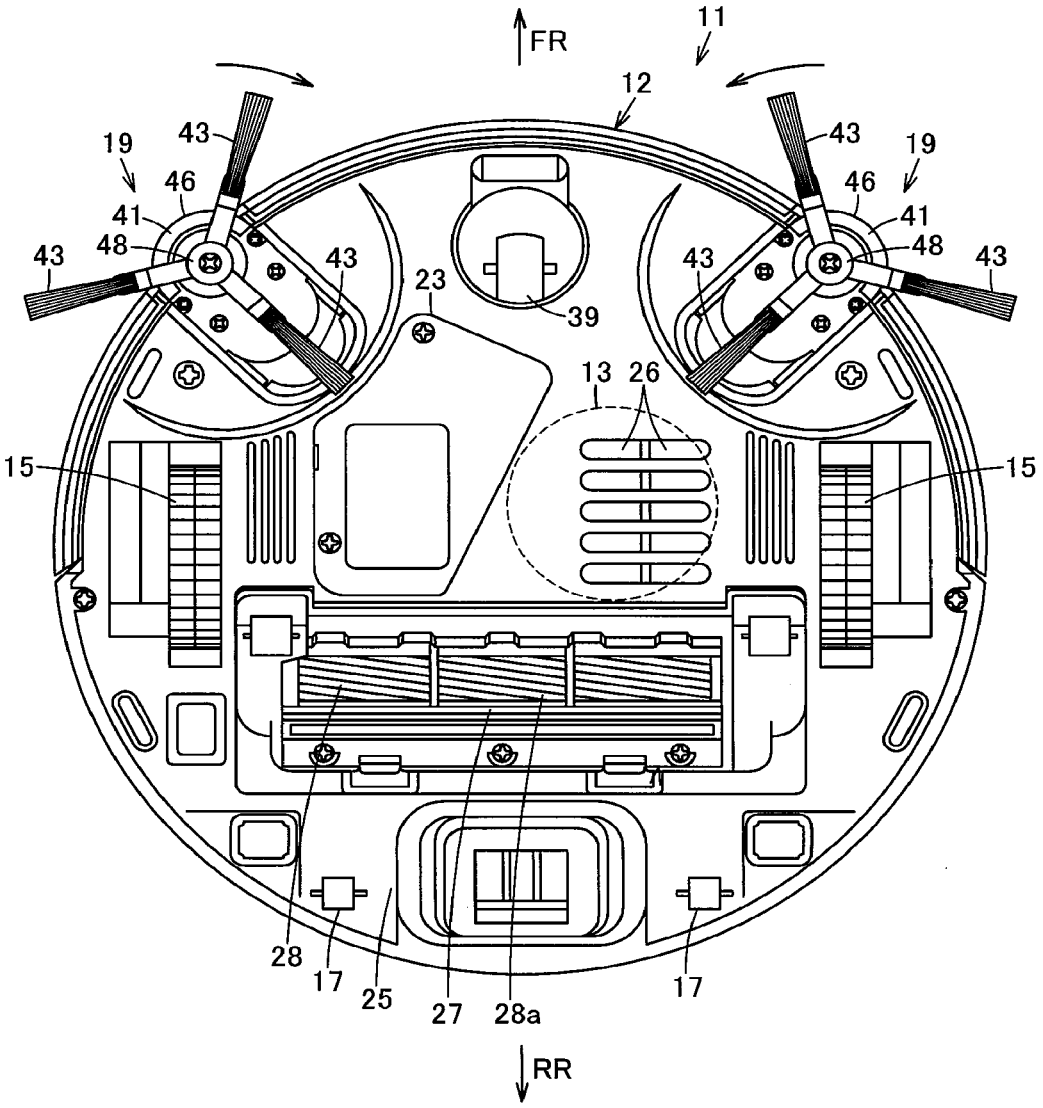
FIG. 2 is a plan view showing the vacuum cleaner from below.
Figure 3:
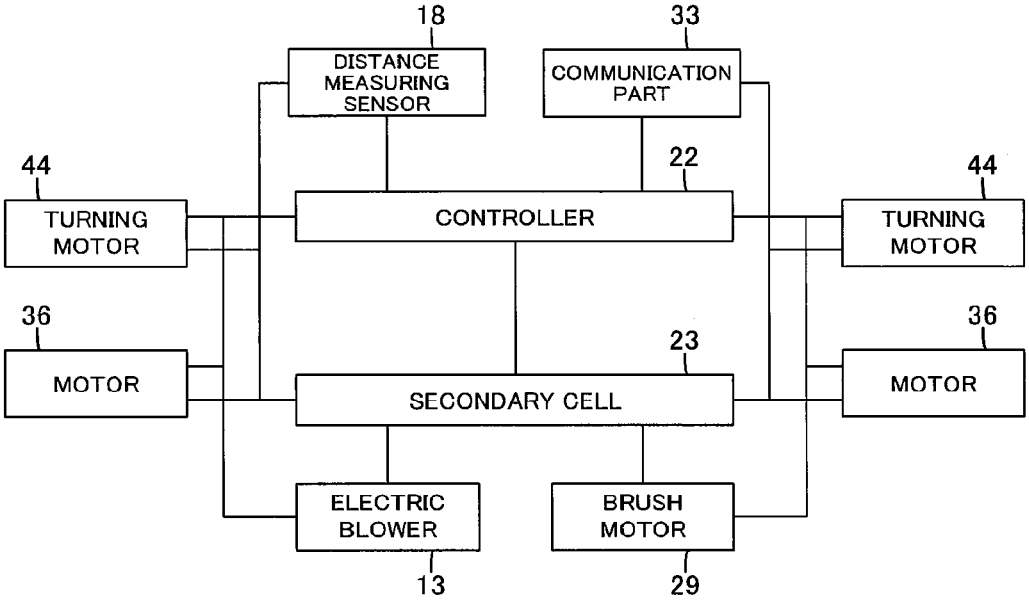
FIG. 3 is a block diagram showing the internal structure of the vacuum cleaner.
Figure 4:
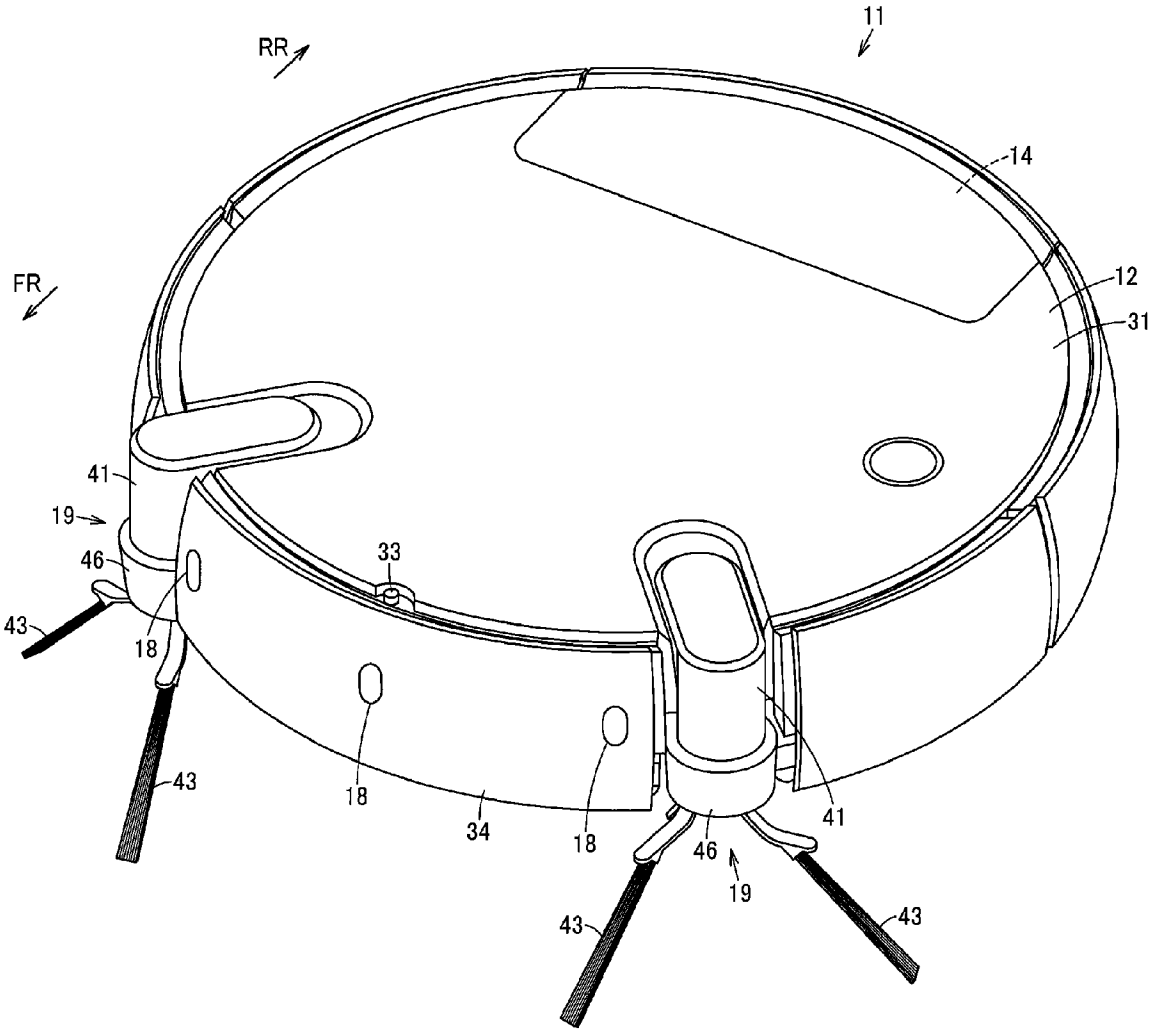
FIG. 4 is a perspective view showing the vacuum cleaner.

The structure of a first embodiment is described below by referring to FIGS. 1A and 1B to 4.

In FIGS. 1A and 1B to 4, 11 indicates a vacuum cleaner. In this embodiment, a so-called self-propelled type robot cleaner to clean a cleaning target surface (floor surface) while traveling autonomously (in a self-propelled manner) on the cleaning target surface is described as an example of the vacuum cleaner 11.

The vacuum cleaner 11 includes a hollow body case 12. The body case 12 accommodates an electric blower 13. A dust collecting part 14 communicating with an intake side of the electric blower 13 is detachably attached to a rear part of the body case 12, for example. The body case 12 is for example provided with: drive wheels 15 as multiple (a pair of) driving parts; multiple driven wheels 17; distance measuring sensors 18 as multiple distance detecting means (distance detecting parts); side brushes 19, 19 that are turning cleaning parts functioning as a pair of cleaning parts; a controller (control means) 22 formed of a circuit board, for example; and a secondary cell 23 that is a cell forming a power supply part. In the description below, a direction along a traveling direction of the vacuum cleaner 11 (body case 12) is called a forward and rearward direction (a direction of an arrow FR and an arrow RR shown for example in FIG. 4). A lateral direction (direction toward both sides) crossing (perpendicular to) the forward and rearward direction is called a width direction. Further, a state where the vacuum cleaner 11 is placed on an even cleaning target surface is assumed to be a reference state.

The body case 12 is formed into the shape of a flat circular column (disc) or the like produced by combining multiple case bodies made of a hard synthetic resin, for example. A lower surface 25 forming a lower part of the body case 12 is formed into a circular shape in a plan view. The lower surface 25 is provided with multiple exhaust ports 26 through which air from the electric blower 13 is to be discharged and an intake port 27 that is a dust collecting port communicating with the dust collecting part 14, all of which are provided open on the lower surface 25. Drive wheels 15, 15 are arranged in positions on both sides of the intake port 27 and closer to a front side. The intake port 27 is arranged in a substantially central area of the width direction of the body case 12 and on a rear side of the forward and rearward direction (ahead of the dust collecting part 14). The intake port 27 is formed to extend longitudinally in the width direction, specifically formed into a horizontally-long rectangular shape. A rotary brush 28 as a rotary cleaning body is rotatably attached to the intake port 27. The rotary brush 28 has an outer circumferential surface on which cleaning members 28*a* such as a bristle brush and a blade are located. The rotary brush 28 is rotated by a brush motor 29 (FIG. 3) as a rotation driving means (rotation driving part) to make the cleaning members 28*a* contact a cleaning target surface repeatedly, thereby sweeping up dust and dirt on the cleaning target surface.

An upper surface 31 forming an upper part of the body case 12 is formed into a circular shape in a plan view. The upper surface 31 has a communication part 33 for radio communication with an external device. The communication part 33 is arranged in a substantially central area of the width direction of a front end portion of the upper surface 31.

The side brushes 19, 19 are arranged on an outer circumferential surface 34 as an outer side surface forming a lateral part of the body case 12 so as to be capable of moving forward and back in a radial direction, specifically, in a normal direction (radial direction) crossing (perpendicular to) a tangential direction of the outer circumferential surface 34. In other words, the side brushes 19, 19 are arranged so as to be capable of moving in a direction in which the side brushes 19, 19 project from the outer circumferential surface 34 and in an opposite direction (direction opposite to the direction of projection).

The electric blower 13 is housed in the body case 12 in a position between the drive wheels 15, 15, for example. The intake side of the electric blower 13 is connected air-tightly to the dust collecting part 14.

The dust collecting part 14 is to accumulate in its inner part dust and dirt sucked in through the intake port 27 in response to drive of the electric blower 13. In this embodiment, the dust collecting part 14 is a dust collecting box that can be attached to and detached from the body case 12.

The drive wheels 15, 15 are to enable the body case 12 to travel (autonomously) on a cleaning target surface. Specifically, the drive wheels 15, 15 are used for traveling. The drive wheels 15, 15 are each formed into a disc shape having a rotary axis extending in the horizontal direction (width direction). The drive wheels 15, 15 are spaced apart from each other in the width direction and arranged in positions near the center of the forward and rearward direction of the lower part of the body case 12. The drive wheels 15, 15 are rotated via motors 36, 36 (FIG. 3) functioning as driving means (driving parts).

The motors 36, 36 are connected via corresponding gear boxes functioning as drive transmitting means (drive transmitting parts) not shown in the drawings to the corresponding drive wheels 15, 15. The motors 36, 36 can drive the corresponding drive wheels 15, 15 independently of each other. The motors 36, 36, the drive wheels 15, 15, and the corresponding gear boxes are integrally biased by a suspending means (suspending part (suspension)) not shown in the drawings in a direction in which the motors 36, 36, the drive wheels 15, 15, and the corresponding gear boxes project downward from the lower surface 25 of the body case 12. This bias maintains force of the drive wheels 15, 15 to grip a cleaning target surface.

The driven wheels 17 (FIG. 2) are arranged on the lower surface 25 of the body case 12 so as to be freely rotate appropriately in positions where the driven wheels 17 can support the weight of the vacuum cleaner 11 in a well-balanced manner together with the drive wheels 15, 15. In particular, the driven wheel 17 arranged in a substantially central area of the width direction of the lower surface 25 of the body case 12 and in a position on a front side functions as a turning wheel 39 attached to the lower surface 25 in a manner that allows the turning wheel 39 to turn parallel to a cleaning target surface.

The distance measuring sensors 18 are non-contact sensors such as ultrasonic sensors or infrared sensors, for example. The distance measuring sensors 18 are for example arranged along a front side or both lateral sides of the outer circumference of the body case 12. The distance measuring sensors 18 are each capable of detecting the presence or absence of an obstacle W (wall section) ahead of the body case 12 and an obstacle W (wall section) lateral to the body case 12 and determining a distance between these obstacles W and the body case 12, for example.

The side brushes 19, 19 prepared for cleaning are to sweep up and collect dust and dirt existing in places external to the contour (outer circumferential surface 34) of the body case 12 such as both sides of the intake port 27 that are beyond the reach of the intake port 27, particularly near an obstacle W (near a wall) or in places ahead of the drive wheels 15, 15. As an example, the side brushes 19, 19 are arranged on both sides of the width direction of the body case 12. In this embodiment, the side brushes 19, 19 are arranged in positions diagonally ahead of a central area of the forward and rearward direction of the body case 12 (forward positions 45 degrees to the right and to the left of the body case 12). The side brushes 19, 19 are each movable in a radial pattern in the radial direction of the body case 12 corresponding to a certain direction. The side brushes 19, 19 each include: a brush body 41 as a cleaning part body; a coil spring 42 that is a coil spring functioning as a cleaning part biasing means (cleaning part biasing body) to bias the brush body 41 in a direction in which the brush body 41 projects from the contour (outer circumferential surface 34) of the body case 12; a cleaning unit 43 rotatably arranged at a lower part of the brush body 41 facing a cleaning target surface; and a turning motor 44 as a turning driving means (turning driving part) to rotate the cleaning unit 43.

The brush body 41 is formed into an elongated shape. The contour of the brush body 41 on a tip as one end, specifically the outer side surface of the brush body 41 is a contact surface 46 exposed to the outside from the outer circumferential surface 34 (envelope surface of a contour that is a virtual circular arc including the outer circumferential surface 34 (extending along the outer circumferential surface 34)) of the body case 12 to contact an obstacle W. In a plan view of the brush body 41 (when the brush body 41 is viewed from above or below), the contact surface 46 projects outward from the outer circumferential surface 34 (envelope surface of the contour) of the body case 12 and an entire portion of the brush body 41 closer to a base end than both sides of the contact surface 46 is arranged inside the outer circumferential surface 34 (envelope surface of the contour). A turning part 48 with the cleaning unit 43 is attached to a lower part of the tip of the brush body 41 facing a cleaning target surface so as to be capable of rotating (turning). The turning motor 44 to cause rotation (turning motion) of the turning part 48 is attached to a base end side as an opposite end side of the brush body 41. A spring receiving part 49 as a connection part to receive the coil spring 42 is attached to a base end portion as one end portion of the brush body 41. The brush body 41 is capable of moving linearly along each guide part 50 of the body case 12 (only the guide part 50 on one side is shown in the drawings) between a position where the contact surface 46 projects outward from the contour, specifically outer circumferential surface 34 of the body case 12 (state of projecting to a maximum) and a position where a tip of the contact surface 46 becomes substantially flush with the outer circumferential surface 34 (state of retreating to a maximum). Specifically, the brush body 41 is capable of advancing and retreating (moving back and forth) by an amount corresponding to projection of the contact surface 46 from the outer circumferential surface 34 (envelope surface of the contour) determined in the absence of external force (except biasing force from the coil spring 42) on the contact surface 46. In other words, the brush body 41 (side brush 19) is to project from the outer circumferential surface 34 of the body case 12 by an amount that changes in response to movement. Each guide part 50 is provided with a stopper part 51 that is, for example, to abut on the corresponding turning motor 44 when the corresponding side brush 19 projects to a maximum.

The contact surface 46 is to project outward and laterally from the outer circumferential surface 34 of the body case 12 when the side brush 19 (brush body 41) projects to a maximum. In a plan view, the contact surface 46 is formed into a circular arcuate surface extending along a circular arc. In this embodiment, the contact surface 46 is formed into an elliptical shape having a long axis extending in a direction crossing (perpendicular to) the radial direction of the body case 12 in which the side brush 19 (brush body 41) is to move. The contact surface 46 is formed into a semi-arcuate shape (semi-elliptical shape) extending across both sides of the brush body 41. Specifically, a circular arc mentioned in this embodiment includes an elliptical arc. The contact surface 46 is formed as a convex arc projecting gradually from the both sides toward the center of the contact surface 46. With this shape of the contact surface 46, in response to external force acting on the contact surface 46 in a direction crossing (perpendicular to) to the certain direction (radial direction of the body case 12) corresponding to a direction in which the side brush 19 (brush body 41) is to move, specifically in a direction T along a tangent to the outer circumferential surface 34 of the body case 12, in other words, external force having a vector component exerting in the direction T along the tangent, this external force is converted to force acting in a direction along the longitudinal direction of the brush body 41. In other words, even if external force acts on the contact surface 46 in the direction T along the tangent, the brush body 41 still moves in a direction in which the brush body 41 retreats toward the outer circumferential surface 34 of the body case 12 (in which an amount of projection from the outer circumferential surface 34 reduces).

The turning part 48 has a rotary axis extending in the vertical direction and is capable of rotating substantially parallel to a cleaning target surface.

The coil spring 42 is to bias the corresponding cleaning part body 41 toward a direction in which the contact surface 46 projects from the outer circumferential surface 34 of the body case 12. The coil spring 42 has a shape like a straight line having one end side held by the spring receiving part 49 of the cleaning part body 41 and an opposite end side held by a holder 52 provided in the body case 12 so as to face the spring receiving part 49.

The cleaning unit 43 is for example formed of brush bristles arranged in a linear pattern. Multiple cleaning units 43 are prepared for each side brush 19 and are arranged in a radial pattern relative to the turning part 48. These cleaning units 43 each have a tip to contact a cleaning target surface and to be deformed along this cleaning target surface. Rotation (turning) of the turning part 48 rotates the cleaning units 43 integrally with the turning part 48 substantially parallel to the cleaning target surface, thereby sweeping away dust and dirt on the cleaning target surface.

The turning motor 44 is configured to rotate the cleaning units 43 parallel to a cleaning target surface, specifically to cause the cleaning units 43 to turn. In this embodiment, the turning motors 44, 44 make the cleaning units 43, 43 turn in directions opposite to each other so as to sweep up and collect dust and dirt existing in places on both lateral sides of the body case 12 toward the center (toward the intake port 27) of the width direction of the body case 12. Specifically, the turning motor 44 of the side brush 19 on the left side makes the cleaning units 43 turn clockwise (to the right). The turning motor 44 of the side brush 19 on the right side makes the cleaning units 43 turn anticlockwise (to the left). The turning motor 44 is attached integrally to the brush body 41 and is capable of moving in the radial direction of the body case 12 together with the brush body 41.

The controller 22 includes a timing means (timing part) such as a timer, a storage means (storage part) such as a memory, and a controller body such as a microcontroller, for example. The controller 22 is electrically connected to the electric blower 13, the distance measuring sensors 18, the brush motor 29, the communication part 33, the motors 36, 36, the turning motors 44, 44, etc. Based on a result of detection by the distance measuring sensors 18, the controller 22 is capable of making the vacuum cleaner 11 conduct cleaning by controlling drive of the electric blower 13, the brush motor 29, the turning motors 44, 44, etc., while making the body case 12 (vacuum cleaner 11) travel autonomously so as to avoid an obstacle W by controlling drive of the drive wheels 15, 15 via the motors 36, 36.

The secondary cell 23 (FIG. 3) is to feed power to the controller 22, the electric blower 13, the distance measuring sensors 18, the brush motor 29, motors 36, 36, the turning motors 44, 44, and the like. As an example, the secondary cell 23 is arranged in a position behind a turning wheel and between the drive wheels 15, 15. The secondary cell 23 is electrically connected to a charging terminal located on the lower surface 25 of the body case 12. The secondary cell 23 can be charged by connecting the charging terminal to a certain charging table not shown in the drawings arranged in a given indoor position (inside a room), for example.

The operation of the first embodiment is described next.

When the vacuum cleaner 11 is placed on a cleaning target surface, the drive wheels 15, 15 come into contact with the cleaning target surface and are then sunk into the body case 12 together with the corresponding gear boxes by the weight of the vacuum cleaner 11 against the bias of the suspending means (suspending part) to reach positions that make the driven wheels 17 (turning wheel 39) contact the cleaning target surface. In response to arrival of a given time established in advance with the controller 22, for example, the electric blower 13 is driven and the vacuum cleaner 11 starts cleaning from the charging table, for example. The cleaning may be started in an arbitrarily settable position such as a position where the vacuum cleaner 11 is to start traveling or a doorway to a room.

In the vacuum cleaner 11, the controller 22 drives the electric blower 13 and the motors 36, 36 detect a distance, for example from a wall section surrounding a cleaning area or an obstacle W existing in the cleaning area, via the distance measuring sensors 18, thereby monitoring the position and the traveling state of the vacuum cleaner 11. In response to the detection from the distance measuring sensors 18, the vacuum cleaner 11 travels on the cleaning target surface while avoiding the obstacle W. In the meantime, the controller 22 rotates each side brush 19 via the corresponding turning motor 44 or drives the rotary brush 28 via the brush motor 29, where necessary.

Regarding each side brush 19 in a normal cleaning state, the contact surface 46 of the brush body 41 projects outward from the outer circumferential surface 34 (envelope surface of the contour) of the body case 12. Thus, each cleaning unit 43 arranged at a tip portion of the brush body 41 and projecting from the turning part 48 reaches the cleaning target surface near the obstacle W such as a wall and the turning motor 44 makes the turning part 48 turn, thereby sweeping away dust and dirt on the cleaning target surface near the obstacle W (FIG. 1A).

If the distance measuring sensors 18 detect the existence of the obstacle W in a place ahead of the vacuum cleaner 11 such as a corner of a room, for example, the controller 22 makes one of the motors 36 drive one of the drive wheels 15 in the forward direction while making the other motor 36 drive the other drive wheel 15 in the rearward direction. This makes the vacuum cleaner 11 (body case 12) turn in situ (ultra-pivotal turn) to face a different direction (forward direction). At this time, if the body case 12 is close to the obstacle W, the contact surface 46 of the brush body 41 of the side brush 19 projecting outward from the outer circumferential surface 34 (envelope surface of the contour) of the body case 12 relatively contacts (collides with) the obstacle W in the turning direction of the body case 12, specifically in the direction T along a tangent to the outer circumferential surface 34 of the body case 12. At this time, the cleaning unit 43 in a position projecting outward from the contact surface 46 contacts the obstacle W to be bent in a direction opposite to the turning direction of the body case 12. Thus, this cleaning unit 43 does not interfere with contact between the contact surface 46 and the obstacle W. The shape of the contact surface 46 extends along a circular arc. Thus, as the body case 12 turns further, external force acting from the obstacle W on the contact surface 46 of the side brush 19 is converted to force exerting in a direction in which the brush body 41 retreats toward the outer circumferential surface 34 of the body case 12. Then, the brush body 41 moves toward the inside of the body case 12 until the brush body 41 comes to a position where the contour of the brush body 41 at the tip of the contact surface 46, specifically the outer side surface of the brush body 41, is placed in a position substantially the same as the outer circumferential surface 34 of the body case 12 (envelope surface of a virtual contour including (extending along) the outer circumferential surface 34), in other words, where an amount of projection of the brush body 41 (side brush 19) from the outer circumferential surface (envelope surface of the virtual contour including (extending along) the outer circumferential surface 34) is substantially zero. This avoids interference with turning of the body case 12 by the brush body 41 getting snagged on the obstacle W (FIG. 1(*b*)). When the contact surface 46 of the brush body 41 is thereafter separated from the obstacle W, the brush body 41 is biased by the coil spring 42 to return toward the outside of the body case 12. Then, the contact surface 46 is again placed in a position projecting outward from the outer circumferential surface 34 (envelope surface of the contour) of the body case 12. The cleaning unit 43 having been bent in the direction opposite to the turning direction of the body case 12 by the contact with the obstacle W has elasticity. Thus, by releasing the cleaning unit 43 from the contact with the obstacle W, the cleaning unit 43 is deformed to recover its original state.

The vacuum cleaner 11 sucks in dust and dirt on the cleaning target surface facing the intake port 27 or dust and dirt swept up and collected with the side brushes 19, 19 together with air through the intake port 27 on which negative pressure generated as a result of drive of the electric blower 13 acts. Further, dust and dirt on the cleaning target surface is swept up through the intake port 27 with the rotary brush 28 being rotated.

The dust and dirt sucked in through the intake port 27 or swept up through the intake port 27 is introduced into the dust collecting part 14 and then collected. The air separated from the dust and dirt is sucked into the electric blower 13 to cool the electric blower 13. Then, the air is exhausted to the outside of the body case 12 as exhaust air through the exhaust port 26.

If determining that cleaning of the cleaning area is finished, the controller 22 makes the vacuum cleaner 11 travel autonomously to the position of the charging table. Then, the controller 22 stops the electric blower 13 and the like, connects the charging terminal to the charging table (physically and electrically), and stops the motors 36, 36, etc. In this way, the controller 22 finishes the operation and chargers the secondary cell 23.

As described above, in the first embodiment, the contour of the tip of the brush body 41 (contact surface 46) exposed in a position projecting outward from the outer circumferential surface 34 of the body case 12 is formed along a circular arc. This achieves a favorable appearance. Further, when external force exerting in the direction T along a tangent to the outer circumferential surface 34 of the body case 12 acts on the contact surface 46, the direction of this external force is converted by this contact surface 46 to a direction in which the brush body 41 retreats toward the outer circumferential surface 34 of the body case 12, thereby allowing the brush body 41 to move readily toward this direction. Thus, even if the contact surface 46 of the side brush 19 contacts an obstacle W in the direction T along the tangent during turning of the body case 12, for example, the side brush 19 can still retreat readily and reliably.

Figure 5A:
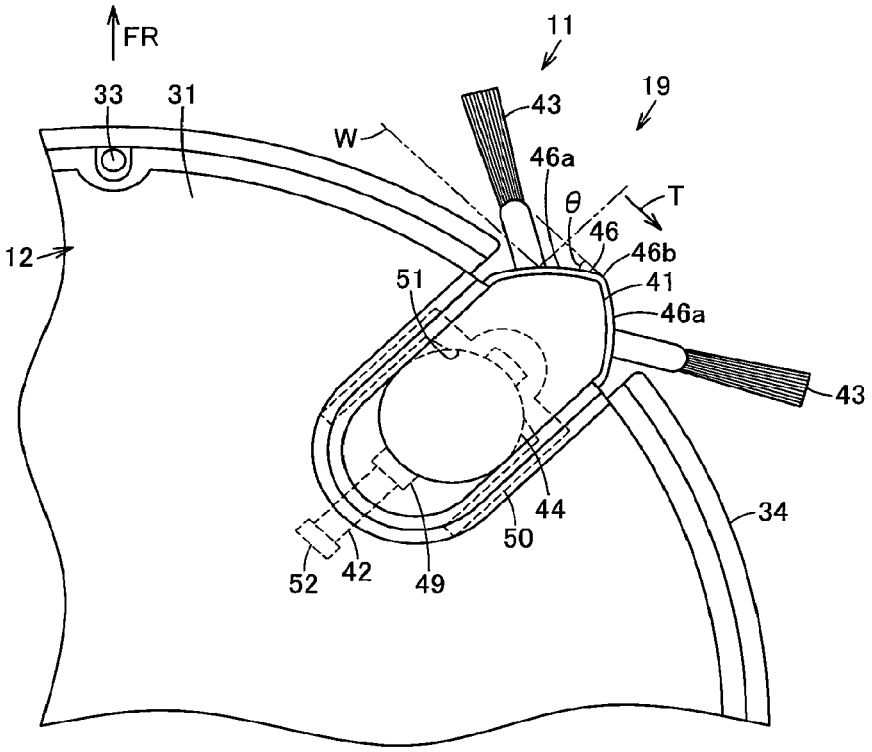
FIG. 5A is a plan view schematically showing a state where a cleaning part of a vacuum cleaner according to a second embodiment advances relative to a body case.
Figure 5B:
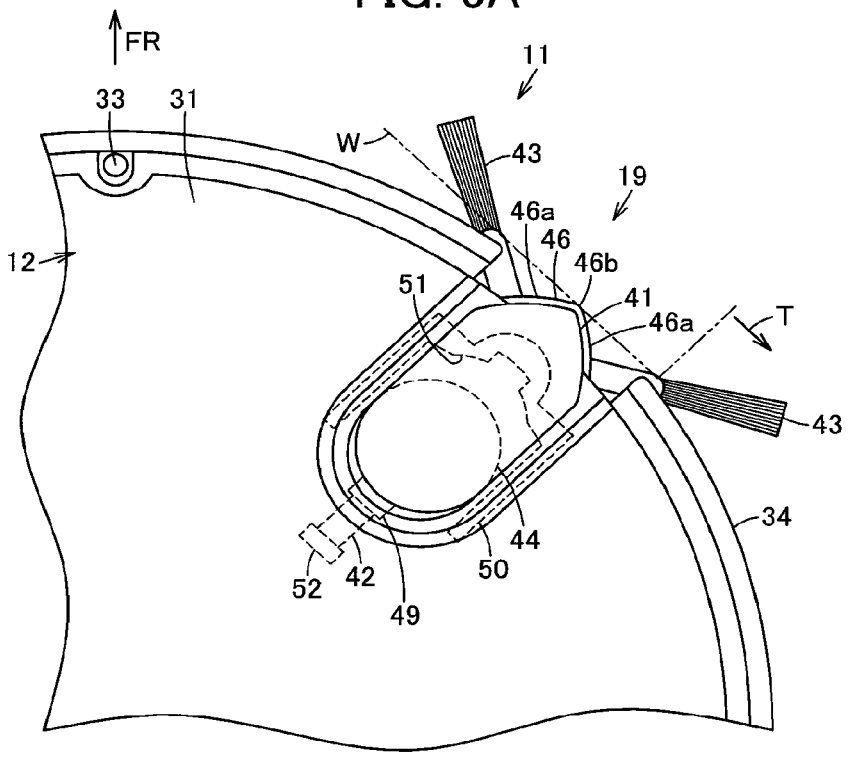
FIG. 5B is a plan view schematically showing a state where the cleaning part retreats relative to the body case.

In the aforementioned first embodiment, the contour of the tip of the brush body 41 (contact surface 46) may be formed into a substantially triangular shape in a plan view as in a second embodiment shown in FIGS. 5A and 5B. In this embodiment, the contact surface 46 is formed into what is called a Reuleaux triangle (shape like a triangular rice ball) with contact parts 46*a*, 46*a* as tilted parts each curved into a circular arc of a comparatively large diameter and bulging outward and a connecting part 46*b* connecting the contact parts 46*a*, 46*a* and curved into a circular arc of a comparatively small diameter. Specifically, a triangular shape mentioned in this embodiment may be a triangle with the flat contact parts 46*a*, 46*a* or may include the aforementioned shape with the contact parts 46*a*, 46*a* bulging outward. The contact part 46*a* (tangent of the contact part 46*a*) is tilted in a direction in which an angle θ of the contact part 46*a* to the direction T along a tangent to the outer circumferential surface 34 of the body case 12 becomes an acute angle, preferably an angle less than 45 degrees. In this embodiment, the contact parts 46*a*, 46*a* tilted from the direction T along the tangent are provided to the contour of the tip of the brush body 41 (contact surface 46) exposed in a position projecting outward from the outer circumferential surface 34 of the body case 12. Thus, when external force exerting in the direction T along a tangent to the outer circumferential surface 34 of the body case 12 acts on the contact parts 46*a*, 46*a* of the contact surface 46, the direction of this external force is converted more reliably by the contact parts 46*a*, 46*a* of this contact surface 46 to a direction in which the brush body 41 retreats toward the outer circumferential surface 34 of the body case 12, thereby allowing the brush body 41 to move readily toward this direction. Thus, even if the contact surface 46 of the side brush 19 contacts an obstacle W in the direction T along the tangent during turning motion of the body case 12, for example, the side brush 19 can still retreat more readily and reliably.

In the aforementioned second embodiment, the tip of the brush body 41 may be formed into a trapezoidal shape with the flat connecting part 46*b* connecting the contact parts 46*a*, 46*a*, for example. This can still achieve comparable working effect.

In each of the aforementioned embodiments, the body case 12 may be provided with a contact obstacle sensor or the like on the outer circumferential surface that is to detect an obstacle W in response to contact with the obstacle W, for example.

The side brush 19 may be arranged only on one side of a place ahead of the intake port 27 of the body case 12.

The electric blower 13 is not an essential structure if dust and dirt can be swept up from the intake port 27 to the dust collecting part 14 with the rotary brush 28.

Likewise, the rotary brush 28 is not an essential structure if dust and dirt can be sucked up from the intake port 27 to the dust collecting part 14 with the electric blower 13. Omitting the rotary brush 28 can make the brush motor 29 unnecessary, thereby achieving a simpler structure.

The outer circumferential surface 34 of the body case 12 is formed into a shape extending along a circular arc. Alternatively, the outer circumferential surface 34 may be formed into a polygonal shape (polygon with four corners or more).

The vacuum cleaner 11 is described as a self-propelled cleaner to travel autonomously while detecting an obstacle with the distance measuring sensors 18, for example. Alternatively, the vacuum cleaner 11 may be a cleaner to be controlled remotely by a user with a remote controller, for example.

In at least one of the aforementioned embodiments, the brush body 41 of the side brush 19 is movable so as to retreat toward the outer circumferential surface 34 of the body case 12 in response to external force acting in a direction crossing the certain direction (radial direction of the body case 12) corresponding to a direction in which the brush body 41 is to move, specifically external force acting in the direction T along a tangent to the outer circumferential surface 34 of the body case 12. Thus, even if the contact surface 46 of the side brush 19 contacts an obstacle W in the direction T along the tangent during turning of the body case 12, for example, the side brush 19 can still retreat readily and reliably.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A vacuum cleaner comprising:

a body case having an outer side surface formed along either a circular arc or a polygon;

a drive wheel to allow travel of the body case on a cleaning target surface; and a cleaning part provided to the body case so as to be linearly movable in a certain direction crossing a traveling direction of the drive wheel, the cleaning part projecting from the outer side surface of the body case by an amount that changes in response to movement, wherein the cleaning part comprises:

a cleaning part body that is movable so as to linearly retreat toward the outer side surface of the body case in response to external force acting in a direction crossing the certain direction; and a cleaning unit rotatably provided to the cleaning part body, the cleaning unit rotating to clean the cleaning target surface.

2. The vacuum cleaner according to claim 1, wherein the cleaning part body has a contour formed along a circular arc at a tip of the cleaning part body.

3. The vacuum cleaner according to claim 1, wherein the cleaning part body has a contour with a tilted part at a tip of the cleaning part body, the tilted part being tilted from the direction crossing the certain direction.

4. The vacuum cleaner according to claim 1, wherein the cleaning part body is movable so as to retreat until the cleaning part body comes to a position substantially the same as an envelope surface extending along the outer side surface of the body case in response to external force acting in the direction crossing the certain direction.

* * * * *